United States Patent [19]

Smith et al.

[11] 4,161,449

[45] Jul. 17, 1979

[54] POWDERED CARPET COMPOSITION

[75] Inventors: James A. Smith, Old Tappan, N.J.; James H. McLaughlin, Chatham, Mass.

[73] Assignee: Airwick Industries, Inc., Carlstadt, N.J.

[21] Appl. No.: 830,238

[22] Filed: Sep. 2, 1977

[51] Int. Cl.[2] ..... D06M 11/04

[52] U.S. Cl. ..... 252/8.6; 8/142; 252/8.8; 264/117; 427/242; 428/394

[58] Field of Search ..... 252/8.6, 8.8; 427/242; 428/394; 8/142; 264/117

[56] References Cited

U.S. PATENT DOCUMENTS

| | | | |
|---|---|---|---|
| 3,161,460 | 12/1964 | Huber | 8/142 |
| 3,240,713 | 3/1966 | Hulsh | 252/88 |
| 3,418,243 | 12/1968 | Hoxie | 252/88 |
| 3,630,919 | 12/1971 | Shaeffer et al. | 252/88 |
| 3,664,961 | 5/1972 | Morris | 264/117 |
| 3,936,537 | 2/1976 | Baskerville et al. | 252/8.8 |
| 3,966,629 | 6/1976 | Dumbrell | 252/8.8 |
| 4,035,148 | 7/1977 | Metzger et al. | 252/88 |

OTHER PUBLICATIONS

Rose The Cond. Chem. Dict., 7th Ed. 1966, Reinhold Publ. Co., p. 299.

*Primary Examiner*—William E. Schulz
*Attorney, Agent, or Firm*—Harry Falber

[57] ABSTRACT

A powdered carpet composition comprising a blend of an inorganic salt carrier, an agglomerating agent such as starch and fragrance, said composition being in proper form for ready application to the carpet and serving to provide deodorizing and/or freshening effects thereto.

10 Claims, No Drawings

POWDERED CARPET COMPOSITION

A major concern in the care and appearance of natural and synthetic carpeting, in addition to basic cleanliness, is the elimination of undesirable and lasting odors. Thus, it is desired that the carpet be substantially free from the musty or foul odors that are frequently encountered in carpets as a result of excess humidity, soil, and the like.

In turn, products which are designed to meet this need should, desirably, be capable of easy application and easy removal. They should exhibit residual effects. When applied in solid form, they should not be overly dusty and should substantially remain in the area of contact with the carpet. They should exhibit appropriate particle size as to be readily removable by vacuuming without reducing the efficiency of the vacuum, as by clogging and the like.

It is, therefore, the primary object of this invention to provide a powdered carpet formulation which imparts deodorizing and freshening properties.

It is a further object to provide a formulation which can be readily applied to and removed from the carpet surface.

Another object is to provide a formulation which will not adversely affect the vacuum during the removal operation.

Still another object is to provide a formulation which is compatible with a variety of optional ingredients so as to be capable of imparting a number of properties while still retaining the basic deodorizing function.

Various other objects and advantages of this invention will be apparent from the following description thereof.

It has now been determined that by preparing a powdered blend of specific particle size, comprising, in specified concentrations, an inorganic salt carrier, an agglomerating agent and a fragrance together with optional ingredients, the above noted characteristics for a carpet treating composition are substantially achieved. Thus, the resulting blend exhibits a powdered appearance without being overly dusty. It can be readily applied to carpets and in view of its agglomerated form, will tend to sit on top of the carpet fibers rather than sifting down through the fibers to the carpet base. In this manner, the blend can be readily removed from the carpet by vacuuming without reducing the efficiency of the vacuuming operation, as by clogging of the system. It is particularly this latter characteristic that represents a significant improvement over previously available carpet-treating formulations.

With regard to the characteristics imparted to the carpet, the fragrance provides deodorizing and freshening properties, which are also imparted to the vacuum cleaner and the surrounding atmosphere by the vacuuming process. Thus, musty and other disagreeable odors are removed from the carpet. Optionally, additives can be included which reduce static cling as well as soil retention and redeposition. It is seen, therefore, that the instant formulations exhibit both immediate and residual effectiveness.

The primary carrier is selected from inorganic salts such as sulfates, chlorides, carbonates, bicarbonates, borates, citrates, phosphates and nitrates. Specific carriers include sodium sulfate, sodium chloride, sodium carbonate, sodium bicarbonate, sodium borate, sodium citrate, sodium tripolyphosphate and sodium nitrate.

The basic feature of these salts is that they be capable of existing in agglomerated form so as to facilitate the application of the formulation on to the carpet surface without excessive dusting or uneven distribution and the subsequent removal thereof. Sodium sulfate carrier is the preferred carrier in view of its relatively high density.

Blends of one or more of the above identified carriers can also be used. For example, certain salts can be included so as to contribute to the product density and further facilitate the agglomerate form sitting on the surface of the carpet fibers. Such salts can also aid in absorbing any liquid components of the formulation.

For purposes of this invention, the particle size distribution of the carrier component should be such that substantially all the particles fall within the range 0.06–0.25 mm. (−60+230 U.S. Standard Sieve Series). In this manner, the very fine and very coarse particles which would tend to interfere with the efficient application, retention and removal of the final product are eliminated. Such particle size distribution will generally be attained by the proper choice of salts, although screening of the final product can achieve a comparable result.

The agglomerating agent is incorporated into the formulation in order to affect the physical characteristics of the product by causing agglomeration of the particles. In this manner, the product tends to remain at the point of contact with the carpet surface rather than forming clouds of dust. As a result, neat and uniform distribution is achieved. The agglomerating agent can also function as a means for identifying the treated area of carpet. Typical agglomerating agents include starch, silica powders, grain flours, wood flour, talc, pumice, clays, calcium phosphates, and the like, with starch being the preferred embodiment.

All conventional fragrances, i.e. volatile odorous agents, including essential oils, aromatic chemicals, and the like, are applicable for use in the instant formulations. A wide variety of such materials is known to those skilled in the perfuming arts. They may comprise one or more natural materials or synthetic aromatic agents or mixtures of the two.

With regard to relative concentrations, the carrier will generally be present in a range of from about 55.0–98.99%; the agglomerating agent in a range of from about 1.0–25.0%; and the fragrance in a range of from about 0.01–20.0%, as based on the weight of the total composition. It should be noted that the carrier can be present in a minimum concentration of 40%, by weight, in any formulations containing more than three ingredients.

A material which imparts anti-static properties and, correspondingly, reduces soil retention and redeposition can be incorporated. Aluminum oxide is the preferred anti-stat, a residue of fine particle size, crystalline alumina imparting anti-static properties to both natural and synthetic carpet fibers. In addition the alumina imparts anti-soil properties which improve the ease of cleaning and maintenance of the carpets. Other applicable anti-static agents include quaternary ammonium chlorides, bromides, or sulfates; cationic quaternary ammonium salts and imidazolium salts; amphoteric tertiary ammonium compounds; nonionic compounds such as tertiary amine oxides, ethoxylated alcohols and alkyl phenols, ethoxylated amines, and tertiary phosphine oxides; anionic soaps, sulfates, and sulfonates, i.e. fatty acid soaps, ethoxylated alcohol sulfates, sodium alkyl sulfates, alkyl sulfonates, sodium alkyl benzene sulfonates, and sodium or potassium alkyl glyceryl ether sulfonates; and zwitterionic quaternary ammonium compounds. The anti-stats will generally be present in the formulation in a concentration ranging up to about 15%, by weight.

In addition, a dedusting agent can be included which serves to reduce the incidence of dust in the formulation and thereby insures uniform application and effective removal. Typical dedusting agents include alkyl phthalates such as dibutyl phthalate; mineral oil; glycols, ethoxylated alcohols, alcohols; glycol ethers; vegetable oils; naphthas and mineral spirits; and napthalene sulfonates. They will generally be present in the formulation in concentrations such that when combined with the fragrance content, the total does not exceed about 5%, by weight. Excessive concentrations tend to increase the adherence of dirt to the carpet fibers as well as to cause excessive agglomeration thereby reducing the ease of application and dispersal.

The instant formulations can be prepared by any conventional blending technique in any addition sequence. The preferred sequence involves (1) blending the carrier, agglomerating agent, and extender and anti-stat, if present, (2) separately mixing the fragrance and any dedusting agents and, finally, (3) admixing the ingredients in step 2 with those of step 1. If necessary, the final product can be screened to remove undesirable fines and/or lumps. The final product will generally exhibit an agglomerated, substantially dust-free appearance and can be readily applied to the carpet by means of any conventional shaking or dusting technique.

The following examples will further illustrate the embodiment of this invention. In these examples, all parts given are by weight unless otherwise noted.

EXAMPLE I

This example illustrates the preparation of a typical composition of the instant invention.

The following component blend was utilized:

| | parts |
|---|---|
| Sodium sulfate | 68.0 |
| Sodium bicarbonate | 20.0 |
| Corn starch | 5.0 |
| Aluminum oxide | 5.0 |
| Dibutyl phthalate | 1.0 |
| Perfume | 1.0 |

The composition was prepared by pre-mixing the sulfate, bicarbonate, starch and aluminum oxide; admixing the perfume with the dibutyl phthalate; and then blending the fragrance mixture with the pre-mix. An agglomerated, substantially dust-free product was obtained utilizing this formulation and utilizing a carrier system having a particle size range of 0.06–0.25 mm.

The product was then sprinkled onto a soiled carpet. It was observed that the product contacted the carpet surface with a minimum amount of dusting. The product was allowed to remain in contact with the carpet fibers for a period of three minutes and then removed by vacuuming. The vacuuming operation proceeded quickly and efficiently. The carpet was observed to have a pleasant, residual odor. Observations over a period of one month revealed the existence of anti-static and anti-resoiling characteristics.

A typical anti-soil test was conducted by treating a carpet with the composition and subjecting it to over 15,000 counts of pedestrian traffic. A Photovolt Reflection Meter was used to measure the soiling characteristic. The untreated section showed a substantial reflectance loss in comparison to the treated section. This indicates that the use of the composition results in less soiling of carpets. Anti-static tests were conducted whereby static electricity build-up by walking upon nylon carpeting was measured using a Stat-Arc Static Electricity Detector. The carpeting was then treated and static electricity was remeasured. A signigicant reduction in static electricity was noted.

EXAMPLE II

The general procedure of Example I was utilized to prepare the following formulation.

| | parts |
|---|---|
| Sodium sulfate | 88.0 |
| Starch | 10.0 |
| Fragrance | 2.0 |

The properties of the resulting formulation were comparable to those of formulation of Example I, with regard to particle size distribution and ease of application and removal.

EXAMPLE III

The following formulations were prepared according to the general procedure described in Example I hereinabove.

| | parts | | | | | | | |
|---|---|---|---|---|---|---|---|---|
| | 3 | 4 | 5 | 6 | 7* | 8 | 9 | 10 |
| Sodium sulfate | 52.5 | 57.0 | 51.0 | 55.0 | 55.23 | 54.73 | 72.0 | 71.0 |
| Sodium bicarbonate | 25.0 | 25.0 | 25.0 | 25.0 | 25.77 | 25.27 | 20.0 | 20.0 |
| Starch | 10.0 | 6.0 | 12.0 | 8.0 | 10.0 | 10.0 | 1.0 | 2.0 |
| Aluminum oxide | 10.0 | 10.0 | 10.0 | 10.0 | 7.0 | 7.0 | 5.0 | 5.0 |
| Fragrance | 2.5 | 2.0 | 2.0 | 2.0 | 2.0 | 2.0 | 2.0 | 2.0 |
| Dibutyl phthalate | — | — | — | — | — | — | — | — |
| Mineral Oil | — | — | — | — | — | 1.0 | — | — |

| | 11 | 12 | 13 | 14 | 15 | 16 | 17 | 18 |
|---|---|---|---|---|---|---|---|---|
| Sodium sulfate | 70.0 | 69.0 | 68.0 | 67.5 | 10.0 | 10.0 | 10.0 | 10.0 |
| Sodium bicarbonate | 20.0 | 20.0 | 20.0 | 20.0 | 60.0 | — | — | — |
| Sodium carbonate | — | — | — | — | — | 60.0 | — | — |
| Sodium borate | — | — | — | — | — | — | 60.0 | — |
| Sodium tripolyphosphate | — | — | — | — | — | — | — | 60.0 |
| Starch | 3.0 | 4.0 | 5.0 | 5.0 | 10.0 | 10.0 | 10.0 | 10.0 |
| Aluminum Oxide | 5.0 | 5.0 | 5.0 | 5.0 | — | — | — | — |

-continued

| | | | | | | | | |
|---|---|---|---|---|---|---|---|---|
| Fragrance | 2.0 | 2.0 | 2.0 | 1.0 | 5.0 | 5.0 | 5.0 | 5.0 |
| Dibutyl phthalate | — | — | — | 1.5 | | — | — | — |
| Mineral Oil | — | — | — | — | — | — | — | — |
| Carbowax 6000 | — | — | — | — | 15.0 | 15.0 | 15.0 | 15.0 |

*Preparative procedure involved blending carbonate with 1.5 parts fragrance, admixing sulfate and aluminum oxide therewith and then admixing a blend of starch and remaining fragrance.

The physical appearance and performance characteristics of most of these formulations were comparable to that of the formulation of Example I. Formulations 4–6 exhibited a somewhat increased dust content while formulation 8 showed increased dirt retention.

Summarizing, it is seen that this invention provides an improved carpet treating composition which exhibits deodorizing characteristics. Variations may be made in proportions, procedures and materials without departing from the scope of the invention as defined by the following claims.

What is claimed is:

1. A powdered carpet-treating composition comprising a blend of from about 40.0–98.99%, by weight, of an inorganic salt carrier selected from the group consisting of sulfates, chlorides, carbonates, bicarbonates, borates, citrates, phosphates, nitrates and blends thereof, substantially all of the particles of said carrier being between 0.06–0.25 millimeters; from about 1.0–25.0%, by weight, of an agglomerating agent selected from the group consisting of starch, silica powders, grain flour, wood flours, talc, pumice, clays and calcium phosphate; from about 0.01–20.0%, by weight, of a volatile odorous agent and up to about 15%, by weight, of an antistatic agent.

2. The composition of claim 1, wherein said carrier is sodium sulfate and said agglomerating agent is starch.

3. The composition of claim 2, wherein said carrier is a blend of sodium sulfate and sodium bicarbonate.

4. The composition of claim 1, wherein said antistatic agent is aluminum oxide.

5. The composition of claim 3, wherein said anti-static agent is aluminum oxide.

6. The composition of claim 1, which also contains an alkyl phthalate dedusting agent, the combined concentration of phthalate and said odorous agent ranging up to about 5.0%, by weight.

7. The composition of claim 6, wherein said alkyl phthalate is dibutyl phthalate.

8. A method for treating natural and synthetic carpets so as to impart deodorizing and air freshening characteristics thereto which comprises applying to the carpet surface, in powdered form, an effective amount of the formulation according to claim 1, and thereafter removing said composition.

9. A method for treating natural and synthetic carpets so as to impart deodorizing and air freshening characteristics thereto which comprises applying to the carpet surface, in powdered form, an effective amount of the formulation according to claim 5, and thereafter removing said composition.

10. A method for treating natural and synthetic carpets so as to impart deodorizing, anti-static and anti-soil redeposition characteristics which comprises applying to the carpet surface, in powdered form, an effective amount of the formulation according to claim 8, and thereafter removing said composition.

* * * * *

Disclaimer 4,161,449.—*James A. Smith,* Old Tappan, N.J., and *James H. McLaughlin,* Chatham, Mass. POWDERED CARPET COMPOSITION. Patent dated July 17, 1979. Disclaimer filed Jan. 3, 1984, by the assignee, *Airwick Industries, Inc.*

Hereby enters this disclaimer to all claims of said patent.

[*Official Gazette December 11, 1984.*]